US006393741B1

(12) United States Patent
Bondy et al.

(10) Patent No.: US 6,393,741 B1
(45) Date of Patent: May 28, 2002

(54) ELECTRIC IRON SOLE PLATE

(75) Inventors: Roger Bondy, Lonral; Jacky Fourny, Berus; Jean-Paul Bouleau, Champfleur, all of (FR)

(73) Assignee: Moulinex S.A., Cormelles le Royal (FR)

( * ) Notice: Subject to any disclaimer, the term of this patent is extended or adjusted under 35 U.S.C. 154(b) by 0 days.

(21) Appl. No.: 09/647,166

(22) PCT Filed: Mar. 23, 1999

(86) PCT No.: PCT/FR99/00671

§ 371 (c)(1),
(2), (4) Date: Sep. 27, 2000

(87) PCT Pub. No.: WO99/50497

PCT Pub. Date: Oct. 7, 1999

(30) Foreign Application Priority Data

Mar. 27, 1998 (FR) ..... 98 03850

(51) Int. Cl.[7] ..... D06F 75/38
(52) U.S. Cl. ..... 38/93
(58) Field of Search ..... 38/93, 79, 80, 38/81, 97; 29/904; 420/442, 528, 550

(56) References Cited

U.S. PATENT DOCUMENTS

| | | | | | |
|---|---|---|---|---|---|
| 2,298,113 | A | | 10/1942 | Ely | |
| 2,846,793 | A | | 8/1958 | Studer | |
| 5,025,578 | A | * | 6/1991 | Firatli et al. | 38/93 |
| 5,105,525 | A | * | 4/1992 | Firatli et al. | |
| 5,619,813 | A | | 4/1997 | Forest et al. | |
| 6,138,389 | A | * | 10/2000 | Kanazawa | 38/93 |

FOREIGN PATENT DOCUMENTS

| | | | | |
|---|---|---|---|---|
| EP | 556721 | * | 8/1993 | 38/93 |
| EP | 0 711 863 | | 5/1996 | |

* cited by examiner

*Primary Examiner*—Ismael Izaguirre
(74) *Attorney, Agent, or Firm*—Young & Thompson

(57) ABSTRACT

Sole plate for pressing iron whose pressing surface comprises a coating improving the sliding of the iron on the materials to be pressed. The coating comprises an underlayer of satin-finished nickel and a surface layer of chromium. The underlayer of satin-finished nickel has a thickness comprised between 5 and 15 microns and the surface layer of chromium has a thickness comprised between 0.06 and 0.3 micron. The outer surface of the coating has a rugosity of at least 30.

9 Claims, No Drawings

ELECTRIC IRON SOLE PLATE

FIELD OF THE INVENTION

The present invention relates to a sole plate for an electric iron adapted to be fixed to a heating body and whose pressing surface comprises a coating improving the sliding of the iron on the material to be ironed.

BACKGROUND OF THE INVENTION

The prior art teaches the provision of many such coatings, thus reflecting the constant care for seeking a material with a very low coefficient of friction to iron all cloth. By way of example can be cited the following coatings: polytetrafluorethylene, enamel, ceramic, stainless steel, chromium, etc.

The applicant has particularly used for a number of years in pressing irons known as OPTIMATE, ULTIMATE, a coating comprising a layer of brilliant nickel covered with a deposit of chromium. Such a coating is known to offer for the most part a high coefficient of sliding over most cloth, as well as an outstanding appearance thanks to its extremely smooth and brilliant surface. However, this smooth surface is not ideal and has, not only a sensitivity to cracking due to mechanical shocks either during production or during improper use, but also a friction which is too high, on synthetic fabric such as polyesters.

OBJECT OF THE INVENTION

The object of the present invention is therefore to overcome the drawbacks mentioned above by providing particularly a coating that will be practically universal for pressing of all cloth by improving substantially the sliding on polyesters.

SUMMARY OF THE INVENTION

According to the invention, the coating comprises an underlayer of satin-finished nickel, and a surface layer of chromium.

According to the applicant, the particular advantage of this coating is due to the typography of its external surface, which has a parameter of rugosity Ra substantially greater than that obtained with a brilliant nickel coating and which is of a ratio at least equal to 30.

Tests carried out by the applicant convincingly prove that the sliding of the sole plate is inversely proportional to the parameter Ra. Micrographic analyses of the typography of the coating show clearly that it has a myriad microcavities, which by interaction with the steam generated during pressing, give rise to an astounding improvement in sliding of the sole plate over all cloth, and particularly polyesters.

DETAILED DESCRIPTION OF THE INVENTION

So as better to understand the invention, there will be given hereafter one example of embodiment of such a sole plate.

The pressing iron comprises a sole plate constituted by a steel support and comprises on its pressing surface a coating improving sliding. This iron can be either of the dry type, or of the steam type, and its sole plate in that case comprises several holes for the escape of steam.

According to the invention, the coating comprises an underlayer of satin-finished nickel and a surface layer of chromium.

Thus, the applicant, by constant efforts of research for new materials, has discovered surprisingly a new application of satin-finished nickel which is a material known to those skilled in the art for other industrial applications and which is described for example in the pamphlet "Electrolytic nickeling" in the "ORGANO GALVANO" review, by Louis Lacourcelle, under the reference: Pamphlet 52 "Information for the Use of the Designer".

According to an important characteristic of the invention, the underlayer of satin-finished nickel has a thickness comprised between 5 and 15 microns, and, in the example of embodiment, a thickness of 11 microns.

So as to increase the resistance to corrosion, a surface layer of chromium has a thickness comprised between 0.06 and 0.3 micron.

To permit good bonding of the satin-finished nickel layer to the steel support, there is moreover provided a deposit of mat nickel in contact with said support and an acid deposit of copper for bonding to the satin-finished nickel.

These different deposits recited above are carried out by electrolytic deposition as is well known to those in the art. Reference can again be had to the pamphlet described above which summarizes three processes, namely: with the addition of argon additives; with inert particles; with emulsions formed of small droplets of oil.

One of the preferred processes of the invention consists in carrying out the following steps beginning with a steel sole plate:

a) chemical degreasing of the sole plate b) pickling c) electro-cathodic/anodic degreasing d) deposition of mat nickel e) acid deposition of copper f) deposition of satin-finished nickel g) deposition of chromium The depositions according to steps d, e, f and g last between 5 and 15 minutes at a bath temperature of the order of 30 to 65° C. with mechanical agitation and a PH comprised between 3 and 7.

Compared to the coatings of the prior art, particularly to that applied by the applicant involving brilliant nickel and chromium, there is noted a surprising improvement of the sliding of the iron sole plate particularly on polyesters, as can be seen from the following table.

Comparative Force of Traction (in Grams)

| Types of cloth | Brilliant nickel/chromium | Satin-finished nickel/chromium |
|---|---|---|
| Polyester | 507 | 219 |
| Polyester-cotton | 367 | 202 |
| Polyester-linen | 231 | 203 |
| Linen | 190 | 173 |
| Cotton | 280 | 220 |

This table shows clearly that the frictional force measured in grams is, for the sole plate according to the invention, particularly decreased and even by the order of two times less for polyester-based cloth.

What is claimed is:

1. Sole plate for pressing iron whose pressing surface comprises a coating improving the sliding of the iron on the materials to be pressed, characterized in that the coating comprises an underlayer of satin-finished nickel and a surface layer of chromium.

2. Sole plate according to claim 1, characterized in that the underlayer of satin-finished nickel has a thickness comprised between 5 and 15 microns.

3. Sole plate according to claim 2, characterized in that the surface layer of chromium has a thickness comprised between 0.06 and 0.3 micron.

4. Sole plate according to claim 3, characterized in that the coating is applied to a steel support.

5. Sole plate according to claim 4, characterized in that, between the support and the underlayer of satin-finished nickel, the coating comprises moreover a deposition of mat nickel in contact with the support and an acid deposition of copper for bonding to the satin-finished nickel.

6. Sole plate according to claim 1, characterized in that the coating is carried out by electrolytic deposition.

7. Sole plate according to claim 1, characterized in that it is mounted on a steam iron.

8. Sole plate according to claim 1, characterized in that the surface layer of chromium has a thickness comprised between 0.06 and 0.3 micron.

9. Sole plate according to claim 2, characterized in that the coating is applied to a steel support.

* * * * *